US010598450B1

(12) United States Patent
Welch et al.

(10) Patent No.: US 10,598,450 B1
(45) Date of Patent: Mar. 24, 2020

(54) MODULAR STOCK ADAPTER AND BUFFER TUBE ELIMINATOR

(71) Applicant: KNS Precision, Inc., Fredericksburg, TX (US)

(72) Inventors: Christian Kager Welch, Fredericksburg, TX (US); Thomas Clauis Barnett, Kerrville, TX (US); Daniel Earl Fisher, Fredericksburg, TX (US); Nicholas Adam Rode, Hunt, TX (US)

(73) Assignee: KNS Precision, Inc., Fredericksburg, TX (US)

( * ) Notice: Subject to any disclaimer, the term of this patent is extended or adjusted under 35 U.S.C. 154(b) by 0 days.

(21) Appl. No.: 16/402,329

(22) Filed: May 3, 2019

Related U.S. Application Data

(60) Provisional application No. 62/671,630, filed on May 15, 2018.

(51) Int. Cl.
*F41A 3/66* (2006.01)
*F41A 11/02* (2006.01)

(52) U.S. Cl.
CPC ..... *F41A 3/66* (2013.01); *F41A 11/02* (2013.01)

(58) Field of Classification Search
CPC ..... F41A 11/02; F41A 3/66
USPC ..... 42/75.03
See application file for complete search history.

(56) References Cited

U.S. PATENT DOCUMENTS

| | | | | |
|---|---|---|---|---|
| 8,468,929 | B2 * | 6/2013 | Larson | F41A 5/28 89/191.01 |
| 10,254,058 | B2 * | 4/2019 | Battaglia | F41A 3/66 |
| 2010/0162609 | A1 * | 7/2010 | Rogers | F41C 23/02 42/85 |
| 2011/0271827 | A1 * | 11/2011 | Larson | F41A 5/28 89/193 |
| 2013/0212920 | A1 * | 8/2013 | Law | F41C 23/14 42/75.03 |
| 2014/0075814 | A1 * | 3/2014 | Larson | F41A 3/66 42/72 |
| 2014/0075816 | A1 * | 3/2014 | Larson | F41A 5/28 42/73 |

OTHER PUBLICATIONS

"MP5K Stock Options with the JMac Customs RSA-MP5K", authored by "Pete" on TheFirearmBlog.com; posted Jun. 5, 2018 (Year: 2018).*

"KNS Precision AR-15 Buffer Tube to Sig MCX Stock Adapter", authored by "Hrachya H" on TheFirearmBlog.com; posted Nov. 28, 2019 (Year: 2019).*

(Continued)

*Primary Examiner* — Samir Abdosh
(74) *Attorney, Agent, or Firm* — Wood Herron & Evans LLP

(57) ABSTRACT

Provided is a modular adapter for a firearm receiver that has a standardized threaded socket for mounting a tubular extension or stock support. The adapter includes a base plug configured to threadably engage the threaded socket of a receiver and a modular adaption element attached to the base plug and against a rear surface of the receiver. The adaption element presents an attachment means for attaching an accessory, such as a stock, to the adaption element.

6 Claims, 5 Drawing Sheets

(56) References Cited

OTHER PUBLICATIONS

Soldier Systems, Post SHOT Show Wrapup—SIG MCX Lower Receiver Adapter http://soldiersystems.net.s016/01/27/post-shot-show-wrapup . . . (5 pages).
SIG Store, MCX Stock Adapter, https://www.sigsauer.com/store/mcx-stock-adapter . . . , printed Mar. 12, 2019, 4 pages.
SIG Store, Fixed/Folding Stock—MCX/MPX|Stocks, https://www.sigasuer/com/store/fixed-folding-stock . . . , printed Feb. 28, 2019, 3 pages.
Soldier Systems, AR Lower Receiver Extension Adapter for SIG MCX Upper, http://soldiersystems.net/2015/02/09/ar-lower-receiver . . . printed Mar. 12, 2019, 3 pages.

* cited by examiner

MODULAR STOCK ADAPTER AND BUFFER TUBE ELIMINATOR

RELATED APPLICATIONS

This application claims priority to U.S. Provisional Patent Application No. 62/671,630, filed May 15, 2018, and incorporates the same herein by reference.

TECHNICAL FIELD

This invention relates to an adapter that provides for rail-mounted accessories onto an AR-pattern lower receiver where a standard stock or buffer tube ordinarily would be mounted.

BACKGROUND

The AR-pattern firearm is among the most popular designs. These include configurations and variants, such as the AR15, AR10, M16, M4, and other variants. The AR-pattern lower receiver features a threaded socket and anti-rotation pocket at the rear where a "buffer tube" or "receiver extension" attaches and contains the recoil spring and buffer. This tube or extension is usually used to support or attach a stock for a rifle configuration or may support an arm brace in a pistol configuration. More recently, accessories and alternate upper receiver designs have appeared that relocate the action spring so the fixed extension or buffer tube at the rear of the receiver is no longer mechanically necessary. AR-pattern accessories that attach to the buffer tube, such as stocks and braces, have likewise become so popular that the threaded socket and anti-rotation pocket used on the AR-pattern have been included on many other types of firearms that do not mechanically require "buffer tubes."

Accordingly, rifle stocks and pistol braces have appeared that replace these non-functional "buffer tubes," adding capabilities, such as folding mechanisms not previously possible for the simple fixed tube. A number of these alternatives have even changed the mounting method at the receiver from the threaded socket of the original AR-pattern socket to a modular rail arrangement similar to that commonly used to mount sighting systems on these firearms. Specifically, these are a "Picatinny Rail," also known as a MIL-STD-1913 or NATO Standardization Agreement 2324 rail, though other standardized rail formats could also be utilized in a similar fashion. At this time, these new rail-mounted accessories cannot be mounted to a standard AR-pattern receiver or other firearms that utilize the same "buffer tube" threaded socket mounting interface, even those where a buffer tube is not mechanically necessary.

SUMMARY OF THE INVENTION

The present invention provides a modular adapter for a firearm receiver that has a standardized threaded socket for mounting a tubular extension or stock support. The adapter includes a base plug configured to threadably engage the threaded socket of a receiver and a modular adaption element attached to the base plug and against a rear surface of the receiver. The base plug and adaption element each include one of an engagement slot and a boss to interlock each against rotation relative to the other. The adaption element presents an attachment means for attaching an accessory, such as a stock, to the adaption element.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
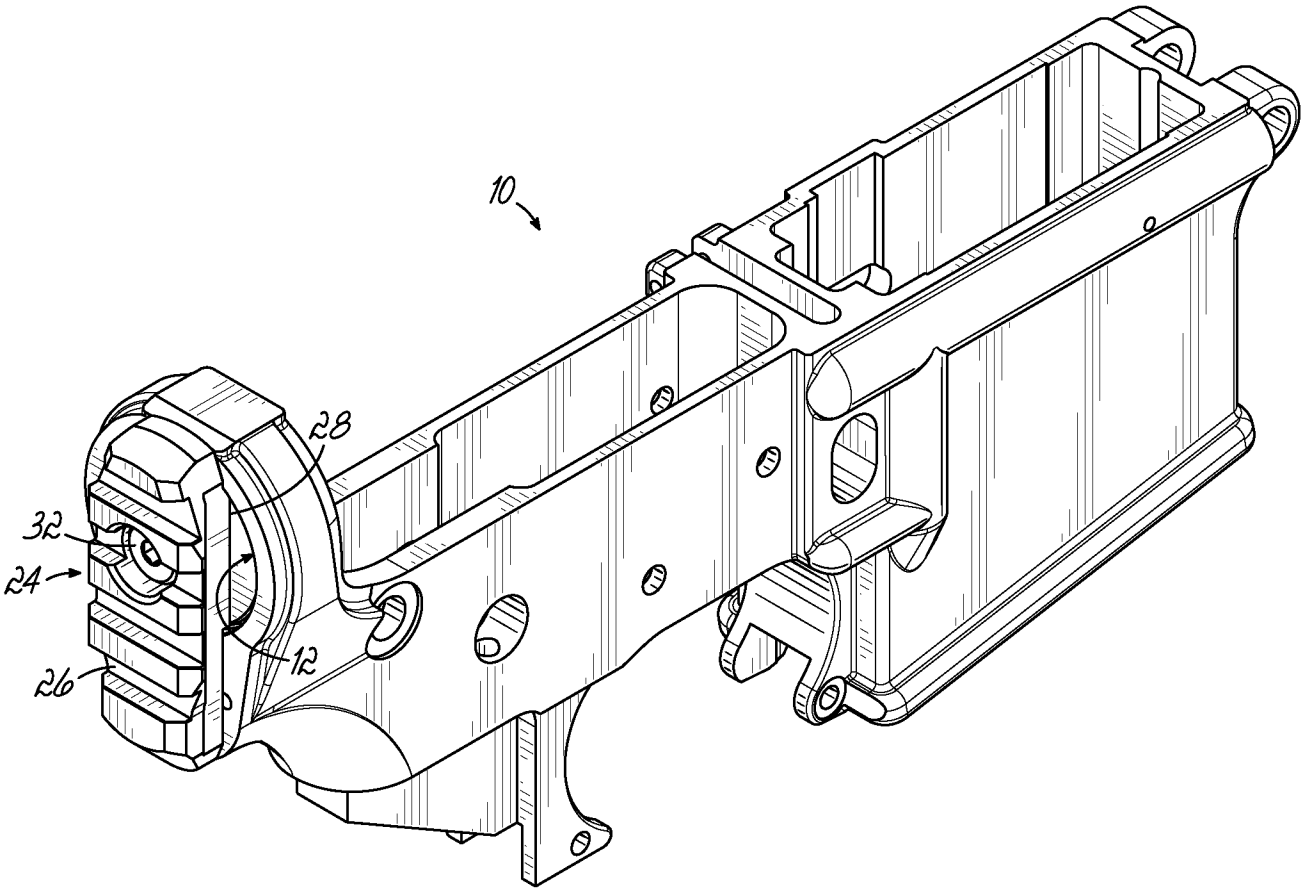
FIG. 1 is an isometric view of an embodiment of the invention installed on an AR-pattern lower receiver.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIG. 1, the device takes the form of an adapter between the common AR-pattern stock or "buffer tube" attachment socket and a modular rail. Referring to all the figures, a firearm receiver 10 includes a threaded socket 12 at a rearward end that can be used to connect a stock and/or a buffer tube or extension tube (not shown). The illustrated receiver 10 is a lower receiver for an AR-pattern firearm, although similar sockets 12 matching this pattern may be found on other firearms system, including, for example, shotguns and chassis for bolt-action rifles. The diameter and thread pitch for this socket 12 is unusual, but standardized. Adjacent the socket 12 is a recess 14 that is also of standardized position and dimensions. The recess 14 was designed to engage a boss on a fixed stock or on an anti-rotation plate used with an adjustable stock.

Figure 2:
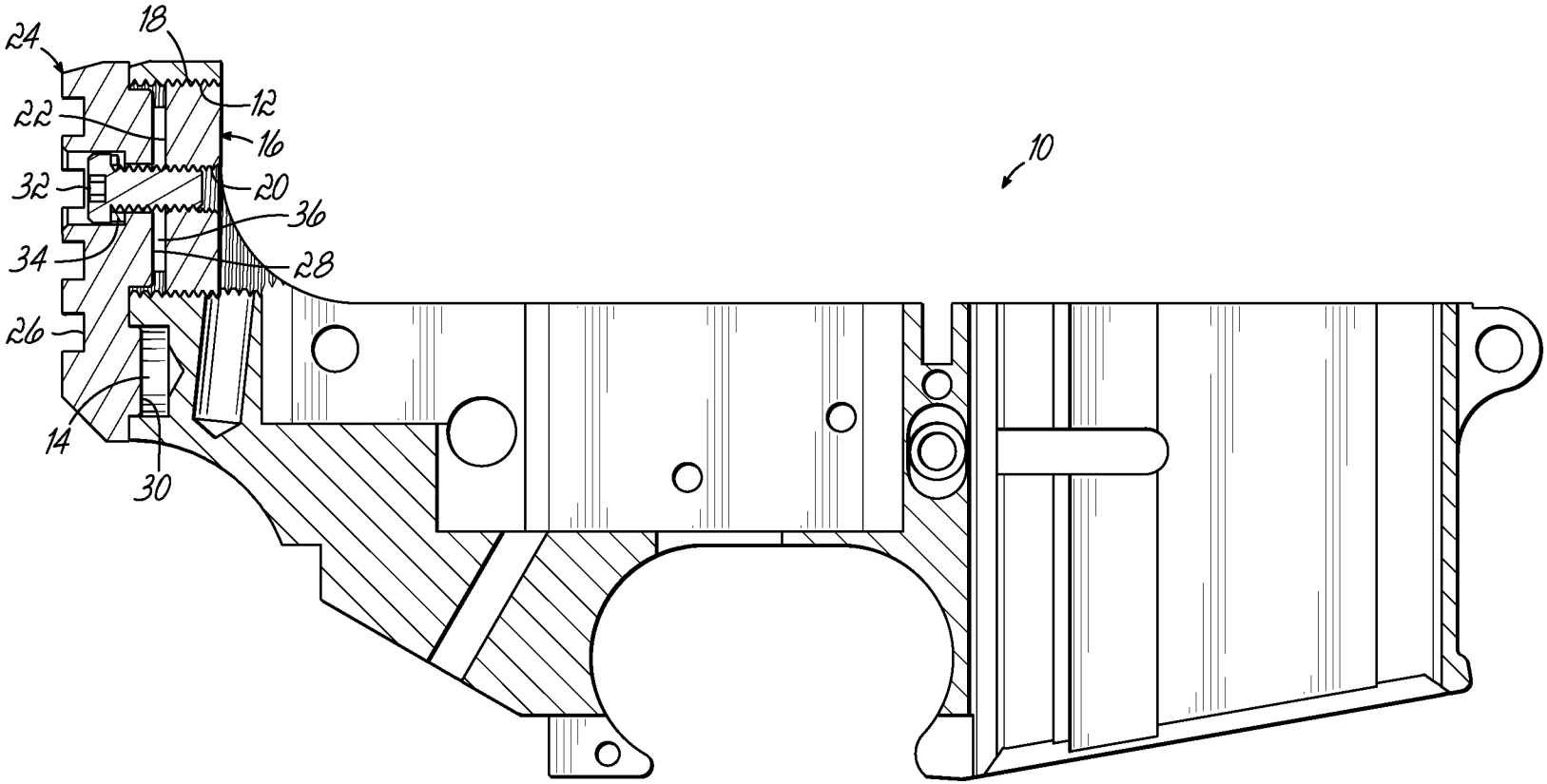
FIG. 2 is a side sectional view thereof.
Figure 3:
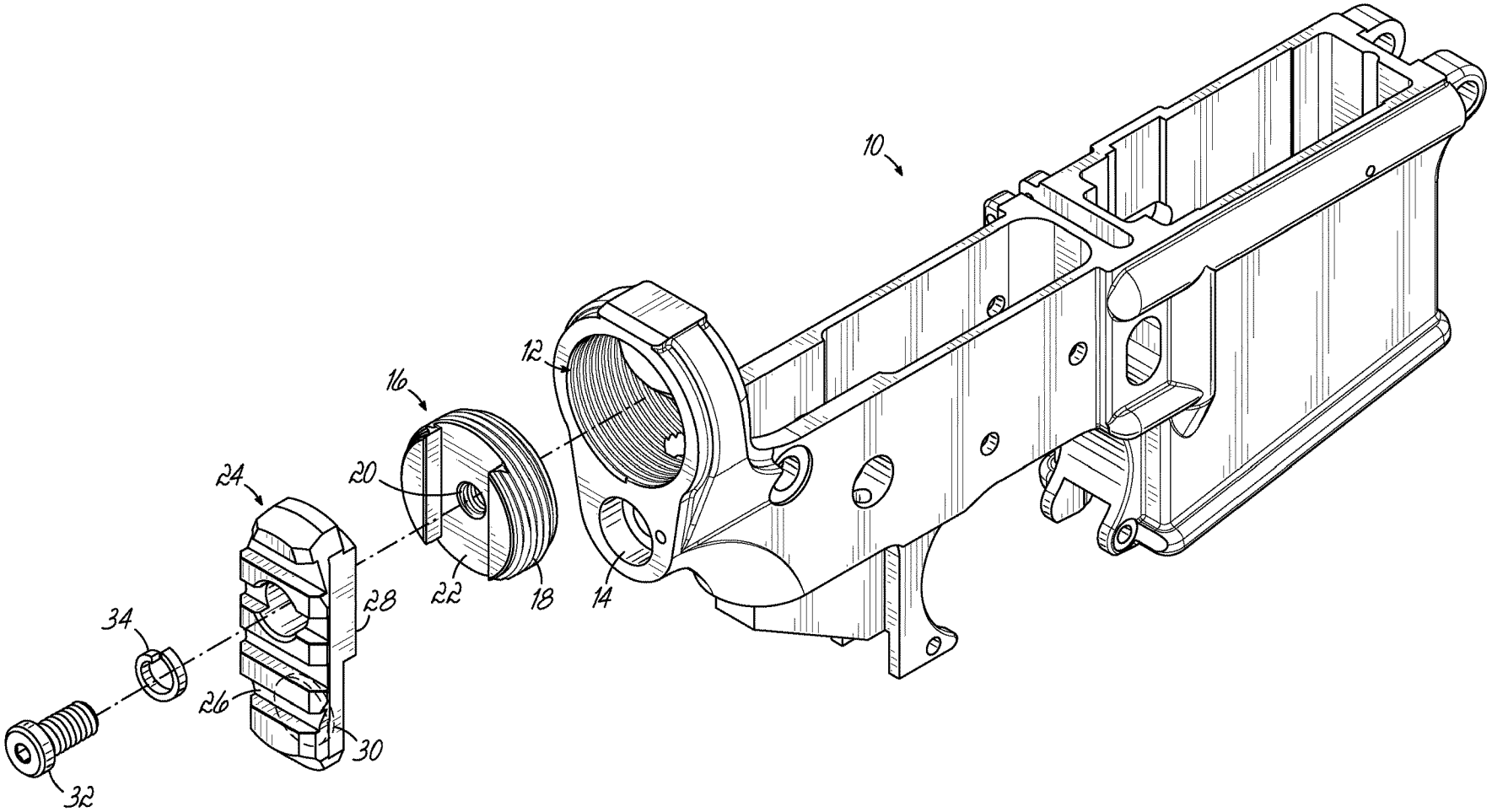
FIG. 3 is an exploded isometric view thereof.
Figure 4:
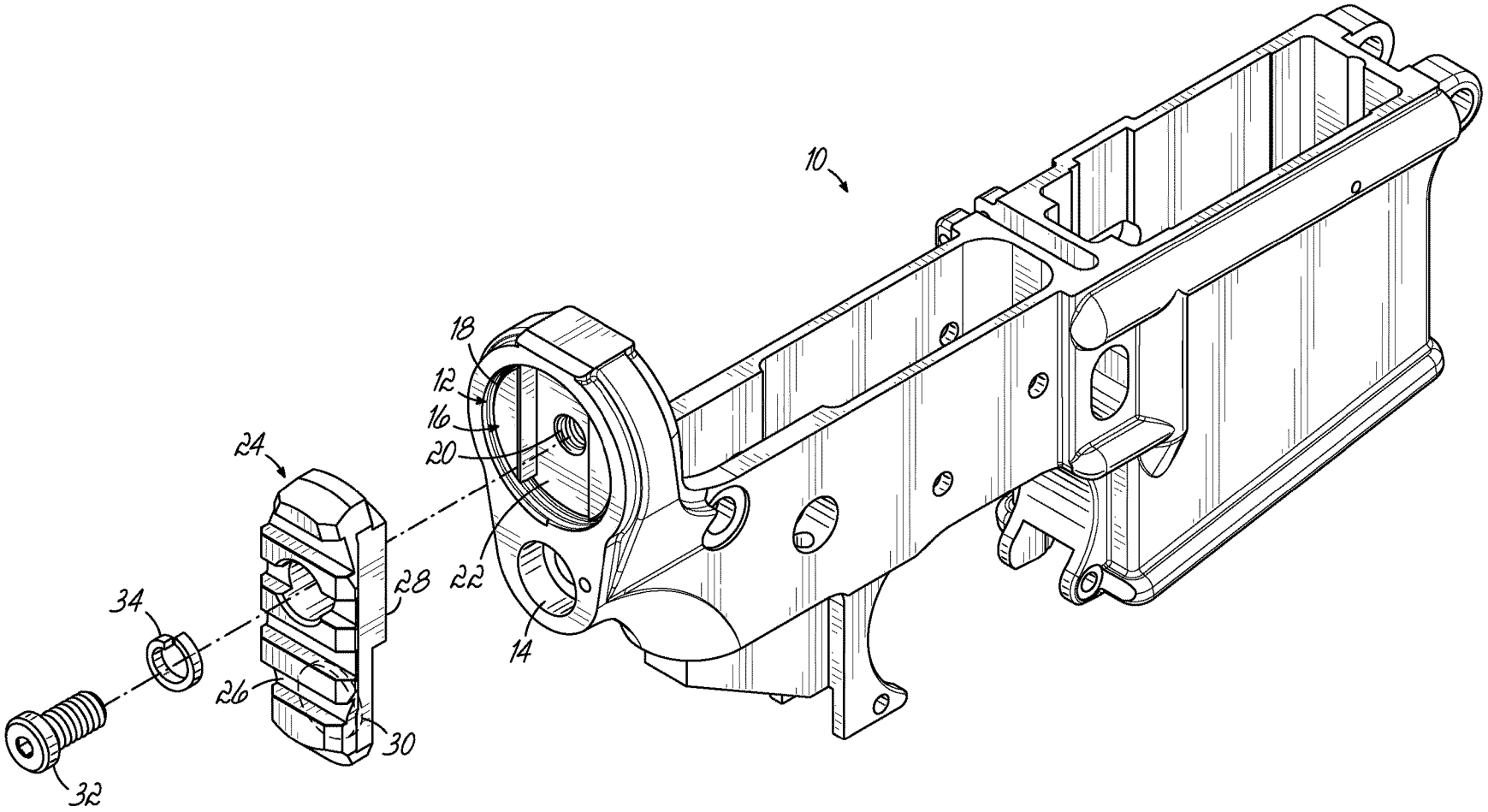
FIG. 4 is a partially exploded isometric view with the base plug installed in the receiver socket.

According to one embodiment of the invention, a base plug 16 has a threaded exterior 18 that is configured to mate with the threaded socket 12 of the receiver, a threaded central bore 20, and a transverse slot 22 on the rear surface. As shown in FIGS. 2 and 4, the base plug 16 closes out the socket 12 and provides a fastening base to which a modular element 24 of the assembly attaches. The base plug 24 can be threaded into the socket 12 using the installer's fingers—a tool should be unnecessary.

Figure 5:
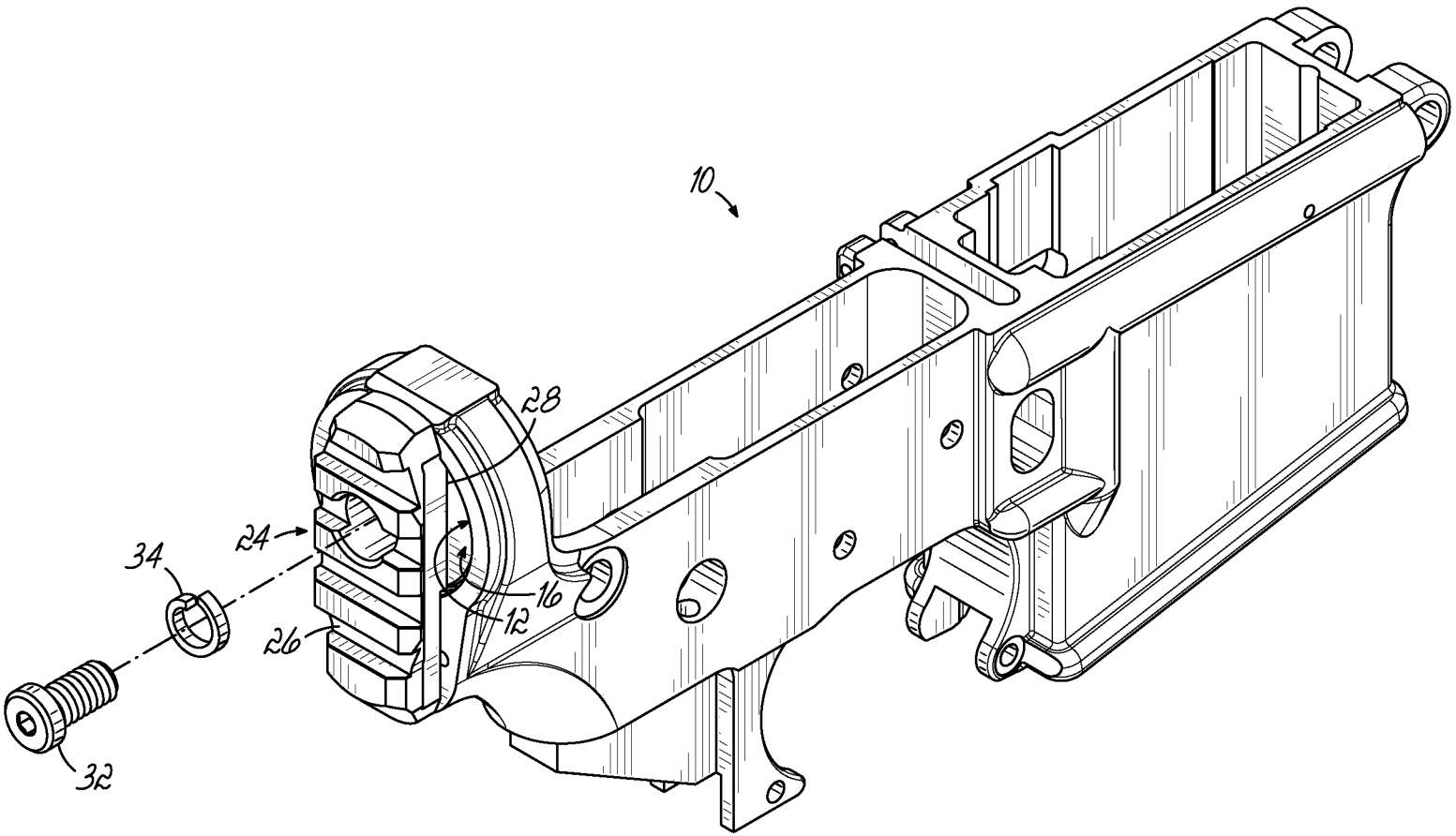
FIG. 5 is a partially exploded isometric view with the rail adapter member installed.

In the illustrated embodiment, the modular element 24 provides a short, vertical section of accessory rail 26 (such as the "Picatinny" or MIL-STD 1913 pattern, shown) as an adaption means. This allows attachment, for example, of a stock designed for use with a Sig Sauer MCX™ or MPX™ type rifle. Other rail shapes or patterns may be used, or a stock connection element of a different type (such as that commonly used for an AK-pattern receiver or the FN Herstal MK 16/17 (SOF Combat Assault Rifle). The modular element 24 may include a boss 28 that fits into the transverse slot 22 of the base plug 16 and/or a second boss 30 that is sized and positioned to engage the offset recess 14 in the receiver 10. In this manner, the modular element 24 is prevented from rotation relative to the receiver 10, shown in FIGS. 2 and 5. In the illustrated embodiment, the base plug 16 must be rotated in half-turn increments to align with the boss 28 of the modular element 24 when installed. It should be appreciated that the base plug 16 could include a boss (not shown) rather than a slot 22 and corresponding engaging elements could be provided on the modular element 24 to prevent rotation. Likewise, a stud (not shown) could be provided for the second recess 14 that would engage an aligned recess (not shown) in the modular element 24. The modular element 24 may be configured to omit the second boss 30 feature for use on receivers or chassis where the threaded socket 12 is present at the mounting surface, but the anti-rotation recess 14 is absent and the second boss 30 would interfere with installation.

A fastener 32 joins these two parts 16, 24 together, locking them tightly to the receiver 10 so as to provide a solid base to which accessories such as rifle stocks may attach. A lock washer 34 may be used with a threaded fastener 32, or the fastener 32 or base plug 16 may have a thread locking feature built into one or the other. The fastener may be tightened with a tool (such as a hex wrench) and the head can be recessed into the modular element 24 so as not to interfere with full function and use of the rail 26. The base plug 16 is secured against both axial movement and rotation once threaded into the socket 12 and keyed to the modular element 24. The modular element 24 is unable to rotate when it is held against the rear surface of the receiver 10 with its second boss 30 is engaging the anti-rotation recess 14 on the receiver 10. As shown in FIG. 2, leaving a gap 36 between the base plug 16 and modular element 24 allows both to clamp to the receiver 10 instead of each other, with the fastener 32 in tension.

With the parts assembled, any accessory utilizing a standard rail mounting system may then be clamped onto the rail section 26. From the user's perspective, the adapter assembly is a fixed part of the receiver 10 and operation is according to the installation requirements of whichever accessory they choose to mount to the rail section 26.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the claim or claims.

What is claimed is:

1. A modular adapter for a firearm receiver that has a standardized threaded socket for mounting a tubular extension or stock support, the adapter comprising:

a base plug having a threaded exterior surface configured to engage with the threaded socket of a receiver; and a modular adaption element attached to the base plug and against a rear surface of the receiver, the adaption element presenting an attachment means for attaching an accessory to the adaption element, wherein the base plug and adaption element each include one of an engagement slot and a boss to interlock each against rotation relative to the other.

2. The adapter of claim 1, wherein the base plug includes a threaded opening and the adaption element is attached to the base plug with a threaded fastener passed through an opening in the adaption element and threaded into the threaded opening of the base plug.

3. The adapter of claim 2, wherein the base plug is axially spaced from the adaption element when installed in a receiver such that the fastener is in tension and the adaption element is pressed against a rear surface of the receiver.

4. The adapter of claim 1, wherein the adaption element includes a portion of MIL-STD 1913 accessory mounting rail.

5. The adapter of claim 4, wherein the rail portion is positioned substantially vertically.

6. The adapter of claim 1, wherein the receiver includes an anti-rotation recess offset from the socket and the adaption element includes a complementary boss that engages the recess when installed.

* * * * *